United States Patent [19]

Husson et al.

[11] Patent Number: 4,457,404

[45] Date of Patent: Jul. 3, 1984

[54] ELEVATOR SYSTEM

[75] Inventors: Alan L. Husson, Hackettstown; Vladimir Uherek, Parsippany, both of N.J.

[73] Assignee: Westinghouse Electric Corp., Pittsburgh, Pa.

[21] Appl. No.: 382,438

[22] Filed: May 26, 1982

[51] Int. Cl.[3] ..... B66B 1/30

[52] U.S. Cl. ..... 187/29 R

[58] Field of Search ..... 187/29 R

[56] References Cited

U.S. PATENT DOCUMENTS

| | | | |
|---|---|---|---|
| 3,523,232 | 8/1970 | Hall et al. | 187/29 R X |
| 3,961,688 | 6/1976 | Maynard | 187/29 R |
| 4,155,426 | 5/1979 | Booker, Jr. | 187/29 R |
| 4,278,150 | 7/1981 | Wehrli et al. | 187/29 R |
| 4,373,612 | 2/1983 | Caputo et al. | 187/29 R |

*Primary Examiner*—Stanley J. Witkowski
*Assistant Examiner*—Paul Shik Luen Ip
*Attorney, Agent, or Firm*—D. R. Lackey

[57] ABSTRACT

An elevator system having an elevator car, a DC drive motor for driving the elevator car, an adjustable voltage DC source for the drive motor, overvoltage and overacceleration detectors responsive to the armature voltage of the drive motor, test apparatus for testing the operability of the detectors during each run of the elevator car, and a protective circuit. The protective circuit initiates an emergency stop of the elevator car in response to overvoltage, or overacceleration, and it prevents the elevator car from starting a new run when the test apparatus detected a malfunction during the prior run.

13 Claims, 4 Drawing Figures

ELEVATOR SYSTEM

BACKGROUND OF THE INVENTION

1. Field of the Invention:

The invention relates in general to elevator systems, and more specifically to traction elevator systems having a DC drive motor and an adjustable voltage source.

2. Description of the Prior Art:

In elevator systems of the traction type having a DC drive motor connected to an adjustable voltage source, such as to a solid state dual bridge converter, or a motor-generator set, it is desirable to monitor the voltage, and the rate of change of voltage, in the armature circuit. It is important that the armature voltage be below a predetermined magnitude when the elevator car is in the process of landing, i.e., stopping at a target floor, especially after the car doors and hatch doors have started to open. It is also important that the rate of change of armature voltage, which is representative of acceleration of the motor and elevator car, be below a predetermined magnitude at all times.

While voltage and acceleration monitoring have been used in the prior art, such arrangements have utilized custom designed transformers, high voltage resistors, and high voltage capacitors, to provide the armature voltage and rate-of-change signals. It would thus be desirable to be able to eliminate custom components, and to reduce the size of the components to the point where the monitoring functions are suitable for PCB mounting in a printed circuitboard cage. Any change to these monitoring functions, however, must not be to the detriment of reliability.

SUMMARY OF THE INVENTION

Briefly, the present invention is a new and improved elevator system of the traction type having a DC drive motor connected to an adjustable voltage source. The special transformer and high voltage resistors used in the prior art are eliminated by deriving a signal responsive to the armature voltage from the same components which are used to provide a signal for armature voltage feedback to the drive control loop. The high voltage capacitor used in the prior art to derive a rate-of-change signal is replaced by a solid state differentiator circuit. In fact, except for three mercury wetted reed relays, the monitoring circuitry is completely solid state, including operational amplifiers, diodes, logic modules, and flip-flops, enabling the circuitry to be placed on printed circuitboards and installed in a PC cage.

Instead of utilizing an overvoltage relay for each travel direction of the elevator car, an absolute value circuit is used to enable one relay to be used for the overvoltage function. The same absolute value circuit is used to provide a signal for a differentiator, which is suitable because it is only necessary to monitor the rate of change of an increasing voltage, i.e., acceleration, as opposed to deceleration.

The overvoltage and overacceleration functions are each checked for operability during each run of the elevator car. A malfunction detected during a run, prevents the elevator car from starting another run. Detection of an overvoltage condition while the elevator car is in the process of stopping at a target floor, or detection of an overacceleration condition at any time, initiates an emergency stop of the elevator car.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
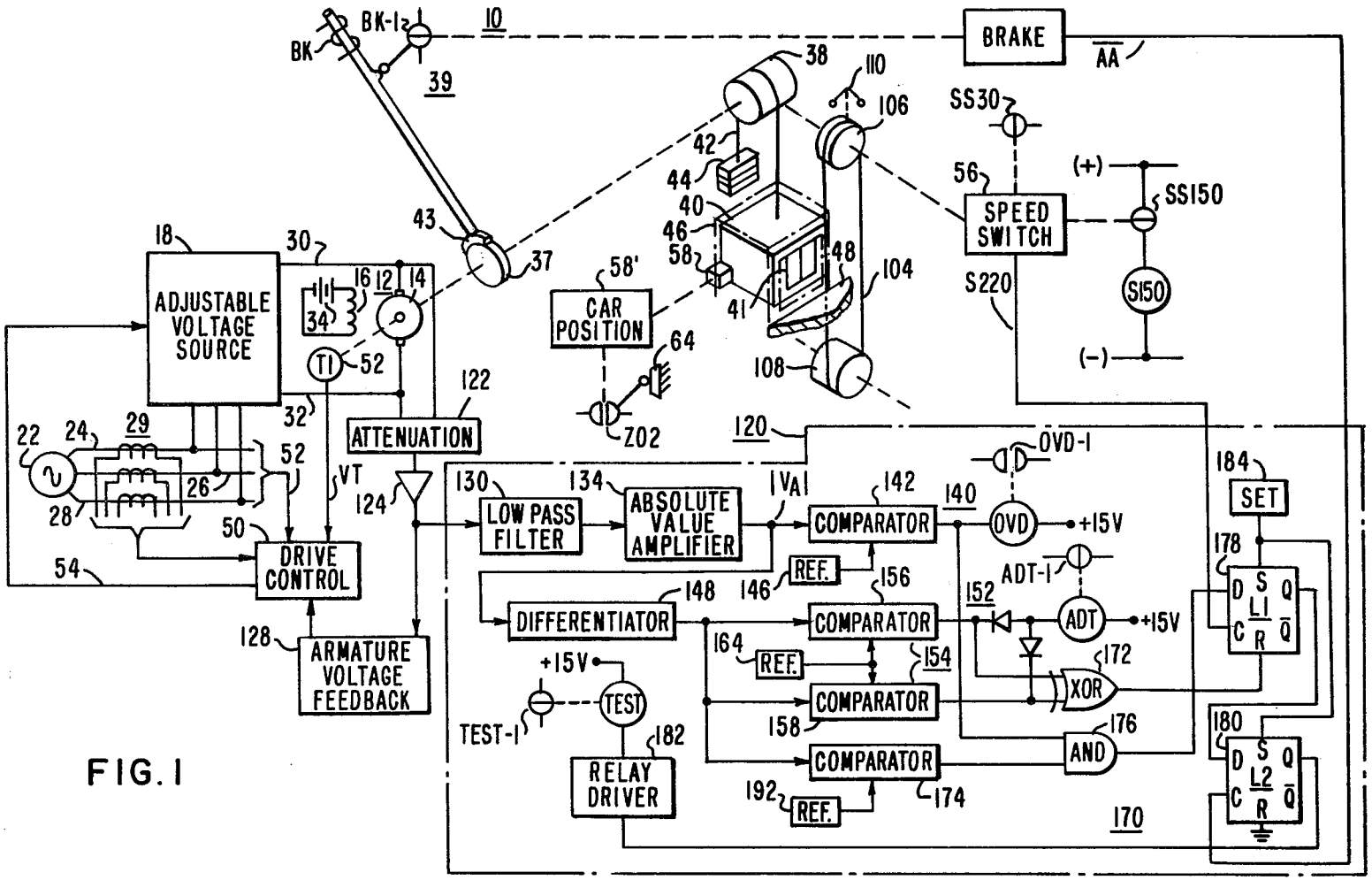
FIG. 1 is a schematic diagram of an elevator system constructed according to the teachings of the invention.

Referring now to the drawings, and to FIG. 1 in particular, there is shown an elevator system 10 of the traction type constructed according to the teachings of the invention. In order to limit the length and complexity of the present application, only those portions of an elevator system which are necessary in order to understand the invention are shown in detail. U.S. Pat. Nos. 3,902,572; 4,042,068; 4,085,823; and 4,308,936, and copending application Ser. No. 375,249 filed May 5, 1982, illustrate drive control which may be used for the drive control shown in block form in FIG. 1, and relays for controlling certain of the contacts shown in FIG. 4. Accordingly, these patents and patent application, all of which are assigned to the same assignee as the present application, are hereby incorporated into the present application by reference.

The illustrated relays, as well as those not shown but whose contents are shown, are listed in the following table.

TABLE

| Signal or Relay | Function |
|---|---|
| $\overline{AA}$ | Logic Signal - This signal is high while the brake is applied, and low while the brake is picked. |
| ADT | Acceleration Monitor Relay - This relay only picks up when an over-acceleration condition is detected. |
| CPR | Protective Relay - This relay must be picked up before the car can start a run, and if it drops out during a run, it initiates an emergency stop. |
| D45 | Master Door Relay - This relay picks up to request door closing, and it drops out to request door opening. |
| D90S | Reset Relay - After power failure, or momentary interruption of the safety circuit, if the car is within the terminal slowdown area, this relay will pick up to run the car at 90 FPM to the terminal floor. |
| OK | Landing Zone Speed Monitor Relay - This relay picks up during landing if the actual car speed is closely tracking the desired speed. |
| OVD | Overvoltage Detector Relay - This relay drops out when the armature voltage exceeds a prede- |

TABLE-continued

| Signal or Relay | Function |
|---|---|
| | termined reference magnitude. |
| SS30 | Speed Switch - This switch is closed at car speeds below 30 FPM, and open above this speed. |
| SS150 | Speed Switch - This switch is closed at car speeds below 150 FPM and open above this speed. |
| S150 | Speed Relay - This relay, which is responsive to SS150, is energized below 150 FPM and dropped out above this speed. |
| S220 | Logic Signal - This signal is a logic zero below a car speed of 220 FPM, and a logic one above this speed. |
| TEST | Test Relay - This relay is energized at the end of a run when a malfunction of the ADT or OVD functions is detected during the run. |
| Z02 | Limit Switch - This switch is closed only when the car is within ± 2 inches of the target floor. |
| 3B | Auxiliary Running Relay - This relay picks up to energize the brake coil and lift the brake at start of a run. |
| 32LB | Cable Stretch Releveling Relay - This relay picks up when the car is running, and it drops out when releveling. |
| 40C | Door Relay - Picked up while the hatch and car doors are both closed and the car is running. |
| 40R | Car Door Relay - Picked up while the car door is closed. |
| 41A | Hatch Interlock Relay - Picked up when the hatch door is closed. |
| 60H | Hand Speed Relay - This relay is picked up on automatic operation, and dropped out on "hand" operation by maintenance personnel. |

Elevator system 10 includes motive means in the form of an elevator drive machine, which includes a DC drive motor 12 having an armature 14 and a field winding 16. The armature 14 is electrically connected, via suitable line contactors, to an adjustable source 18 of direct current potential. The source of potential may be direct current generator of a motor-generator set in which the field of the generator is controlled to provide the desired magnitude of unidirectional potential; or, a static source, such as a dual converter. For purposes of example, it will be assumed that source 18 is a static source as shown and described in detail in U.S. Pat. No. 4,085,823. This patent also discloses an arrangement for developing signals responsive to actual car speed.

The drive machine of the elevator system 10 includes an alternating current portion comprising a source 22 of alternating potential and buses 24, 26 and 28. The direct current position of the drive machine includes buses 30 and 32, to which the armature 14 of the direct current motor 12 is connected. The field winding 16 of drive motor 14 is connected to a source 34 of direct current voltage, represented by a battery in FIG. 1, but any suitable source such as a single bridge converter may be used.

The drive motor 12 includes a drive shaft indicated generally by broken line 36, to which a brake drum 37 and a traction sheave 38 are secured. An elevator car 40, having a door 41, operable between open and closed positions, is supported by a plurality of ropes 42 which are reeved over the traction sheave 38, with the other ends of the ropes being connected to a counterweight 44. The elevator car is disposed in a hoistway 46 of a structure or building having a plurality of floors or landings, such as floor 48, which floors are served by the elevator car. Each floor includes a hatch door which is operated in unison with the elevator door 41, when the elevator car 40 is at the associated floor. The brake drum 37 is part of a brake system 39 which includes a brake shoe 43 which is spring applied to the drum 37 to hold the traction or drive sheave 38 stationary, and it is released in response to energization of a brake solenoid coil BK. When the brake is applied, a contact BK-1 is closed, and when the brake is picked up, contact BK-1 is open, which contact is utilized in the control circuits.

The movement mode of the elevator car 40 and its position in the hoistway 46 are controlled by the voltage magnitude applied to the armature 14 of the drive motor 12. The magnitude of the direct current voltage applied to armature 14 is responsive to a velocity command signal provided by a suitable speed pattern generator located in the drive controls shown generally at 50. The servo control loop for controlling the speed, and, thus the position of car 40 in response to the velocity command signal, also included in drive control 50, may be of any suitable arrangement such as shown in U.S. Pat. No. 4,085,823. Current feedback for the drive control 50 is provided by current transformers 29, synchronizing or timing signals are provided from the AC buses, as indicated by conductor 52, and firing pulses for the controlled rectifier devices of the static source 18 are provided by drive control 50, as indicated by conductor 54.

As disclosed in U.S. Pat. No. 4,085,823, two tachometers may be used in a self-checking manner to provide car speed information; or, as illustrated, a single tachometer T1 may be used, as desired. Tachometer T1 provides a signal VT responsive to the actual speed of the elevator drive motor 12. Tachometer T1 may be coupled to the shaft of the drive motor 12 via a rim drive arrangement. When a second tachometer is used, it may be driven from the governor assembly, which includes a governor rope 104 connected to the elevator car 40, reeved over a governor sheave 106 at the top of the hoistway 46, and reeved over a pulley 108 connected to the bottom of the hoistway. A governor 110 is driven by the shaft of the governor sheave, and the second tachometer may also be driven by the shaft of the governor sheave 106, such as via a belt drive arrangement.

FIG. 1 illustrates a car speed switch 56 driven by the elevator system, such as belt driven from the governor sheave 106. U.S. Pat. No. 3,802,274 illustrates a speed switch which may be used. Speed switch 56 provides independent indications of car speed for use in the landing zone, with contacts SS150 closing when the car speed is less than 150 FPM, and contacts SS30 closing when the car speed is less than 30 FPM. To provide additional contacts for the 150 FPM point, the SS150 contacts are connected to control a relay S150. Contacts S150-1 of relay S150 are closed below 150 FPM, and open above this speed. A contact-to-logic level interface provides a signal S220, which is a logic zero below a car speed of 220 FPM, and a logic one above that speed. U.S. Pat. No. 4,085,823 also discloses apparatus for developing such speed signals electrically, from the two tach self-checking arrangement.

Car position signals relative to the landing zone adjacent to each floor level are indicated as being provided by car position means 58, which, as illustrated adjacent to block 58', may be provided by cams and switches. For example, cam 64 may be disposed on a suitable cam tape strung in the hoistway, with the cams being attached to the tape adjacent to each floor. Switch Z02 is mounted on the elevator car 40 and oriented to make contact with cams 64. Switch Z02 is normally open, closing its contacts only when the elevator car is within two inches from the level of the target floor, with the target floor being a floor at which the elevator car 40 is preparing to make a stop. Switch Z02, for example, may be used to initiate pre-opening of the door 41, or door pre-opening may be initiated earlier in response to another switch/cam arrangement. For example, other switches and cams may be used to define the limits of the landing zone, which is about ±10 inches from floor level, and the leveling zone, which is ±0.25 inch from floor level.

The present invention includes an armature voltage monitoring circuit 120. Monitoring circuit 120 is shown partially in block form in FIG. 1, with an exemplary implementation of monitoring circuit 120 being shown in FIG. 2. Both will be referred to during the following description. The timing diagrams shown in FIG. 3 will also be referred to, where appropriate, to aid in the understanding of the operation of the monitoring circuit 120.

Instead of developing an armature voltage signal specifically for monitoring circuit 120, the present invention utilizes circuitry already available in the elevator system which develops an armature voltage feedback signal for the drive control loop 50. This circuitry includes an attenuation circuit 122 connected across armature 14, which includes a resistive voltage divider network, and an amplifier 124, such as an operational amplifier (op amp) 126. The output of amplifier 124 is applied to the armature feedback circuit 128.

The output of amplifier 124 is used as the source of the armature voltage signal for the monitoring circuit 120, with this signal being applied to a low pass filter 130, which may include an op amp 132 connected in an active filter configuration. Filter 130 filters the 360 Hz ripple inherent in the output of a solid-state dual converter.

The polarity of the armature voltage depends upon the rotational direction of the armature 14, which in turn determines car travel direction. An absolute value circuit 134 converts the filtered output signal from filter 130 to a positive polarity signal $|V_A|$, regardless of the polarity of the input signal, eliminating the need for an overvoltage detector for each travel direction. The absolute value circuit 134 may include op amps 136 and 138 connected as a precision rectifier and as a summing amplifier, respectively.

The absolute value signal $|V_A|$ is applied to overvoltage means 140, which includes a comparator 142 and a mercury wetted reed relay OVD having a n.o. contact OVD-1. Comparator 142 may include an op amp 144 connected as a comparator and relay driver, with the signal $|V_A|$ being applied to the non-inverting input, and with a positive reference voltage source 146 being applied to the inverting input. Relay OVD has one end of its electromagnetic coil connected to a positive source of potential, and its other end is connected to the output of op amp 144. The reference 146 is adjusted such that the reference voltage exceeds $|V_A|$ in the landing zone. Thus, during normal operation, comparator 144 outputs a logic zero, energizing relay OVD, while the car is stationary, and it switches to a logic one when $|V_A|$ exceeds the preset trigger level, deenergizing relay OVD, as the car acclerates away from a floor at the start of a run. The output of comparator 144 goes back to a logic zero, picking up relay OVD, as the car slows down and enters the landing zone of the target floor. The connection of contact OVD-1 will be hereinafter explained.

The output signal $|V_A|$ of the absolute value circuit 134 is further applied to a differentiator 148, which may include an op amp 150 connected in a differentiator configuration. Differentiator 148 provides an output signal $V_{ACC}$ proportional to the rate-of-change of the armature voltage, which is proportional to the motor and car acceleration.

Signal $V_{ACC}$ is applied to overacceleration means 152, which includes comparator means 154 and a mercury wetted reed relay ADT. Relay ADT has a normally closed contact ADT-1. Comparator means 154 includes a pair of comparators 156 and 158, which may include op amps 160 and 162, respectively, connected as comparators and relay drivers. Comparators 156 and 158 are similar, with each having their non-inverting inputs connected to receive signal $V_{ACC}$ and their inverting inputs are connected to the same negative source 164. Thus, the outputs of op amps 160 and 162 are normally high, i.e., logic ones. They only switch to a logic zero in the event the signal $V_{ACC}$ becomes more negative than reference 164, signaling an overacceleration condition. Relay ADT has one side of its electromagnetic coil connected to a positive source of potential, and its other end is connected to the outputs of op amps 160 and 162 via an OR circuit which includes diodes 166 and 168. Thus, if either comparator output should go to logic zero, relay ADT would be energized.

Figure 4:
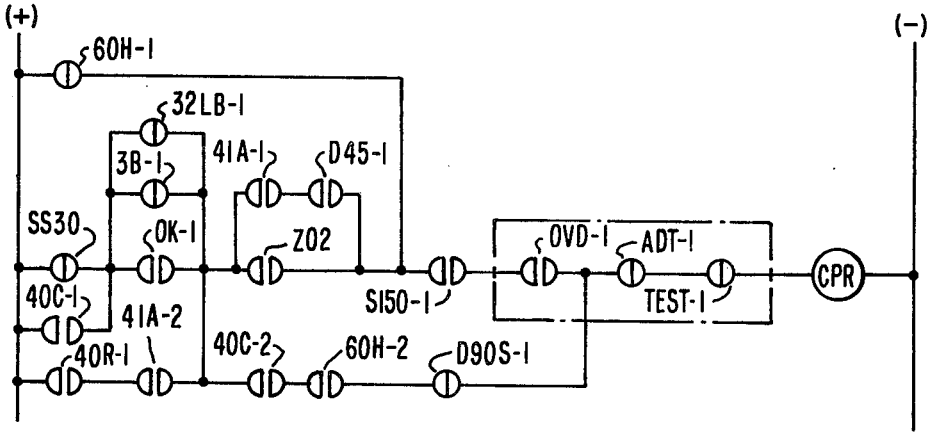
FIG. 4 is a schematic diagram of a protective relay CPR, illustrating how the monitoring functions of FIGS. 1 and 2 provide signals for the protective relay function.

Contacts OVD-1 and ADT-1 of the overvoltage and overacceleration relays OVD and ADT, respectively, are connected in the circuit of a protective relay CPR, shown in FIG. 4. Relay CPR must be picked up before the elevator car 40 can make a run, and if it drops out during a run, it initiates an emergency stop of the elevator car 40. An emergency stop involves removing the drive voltage from the drive motor, and the setting of the friction brake 39. When the elevator car 40 is on automatic operation and is stationary at a floor level with its door 41 open, relay CPR is energized through the circuit which includes contacts:

TEST-1; ADT-1; OVD-1; S150-1; Z02; 3B-1; SS30.

When the car door 41 and associated hatch door closes at the start of a run, relay CPR is energized through the following circuit:

TEST-1; ADT-1; D90S-1; 60H-2; 40C-2; 41A-2; 40R-1.

It will be noted that contacts OVD-1 are not in this circuit, as contact OVD-1 opens normally during a run, at a predetermined armature voltage level. Contact ADT-1, however, is in both circuits, and if relay ADT should be energized at any time, contacts ADT-1 will open to drop relay CPR and initiate an emergency stop of the elevator car. It will also be noted from FIG. 3, that signal $V_{ACC}$ is negative only during acceleration of the elevator car, indicated by an increasing armature voltage $|V_A|$. Thus, comparator means 154 only checks acceleration, not deceleration. The only time the deceleration rate will exceed the reference rate-of-change level is during an emergency stop, or a safety stop, and thus it is not necessary to monitor deceleration.

As the elevator car 40 approaches the target floor, and the doors start pre-opening, such as at the 2-inch point in the example of FIG. 4, relay CPR is energized through the following circuit:

TEST-1; ADT-1; OVD-1; S150-1; Z02; OK-1; SS30.

It will be noted that the overvoltage detection circuit is now enabled, with the overvoltage function monitoring for an armature overvoltage condition during the landing process. Should the armature voltage exceed the reference voltage during this time, relay OVD will drop, its contact OVD-1 will open, and relay CPR will drop out to initiate an emergency stop at the elevator car.

Thus, dropout of the overvoltage relay OVD when the car and hatch doors are not closed, will stop the car, if it is moving, and/or prevent it from restarting. Pickup of the overacceleration relay ADT at any time will initiate an emergency stop of the elevator car and prevent it from being restarted, until maintenance personnel correct the cause.

During reset following power interruption, or following a momentary interruption of the safety circuit, relay D90S will pick up and run the car to a terminal floor if the car is in the terminal slowdown zone. Contact D90S-1 opens to ensure that this operation is carried out below 150 FPM.

Monitoring circuit 120 includes self-testing means 170 which is operational during a run of the elevator car. The testing means 170 tests the operability of the overvoltage and overacceleration means. Since when the testing means indicates a malfunction, it does not mean that an actual overvoltage or overacceleration condition has occurred, the operation of the test means allows the car to complete its present run, and it then prevents the car from restarting until the malfunction has been corrected.

The test means 170 includes an exclusive OR (XOR) gate 172, comparator means 174, an AND gate 176, first and second latch means 178 and 180, respectively (L1 and L2), a relay driver 182, and a mercury wetted reed relay TEST, which has a n.c. contact TEST-1.

Figure 3:
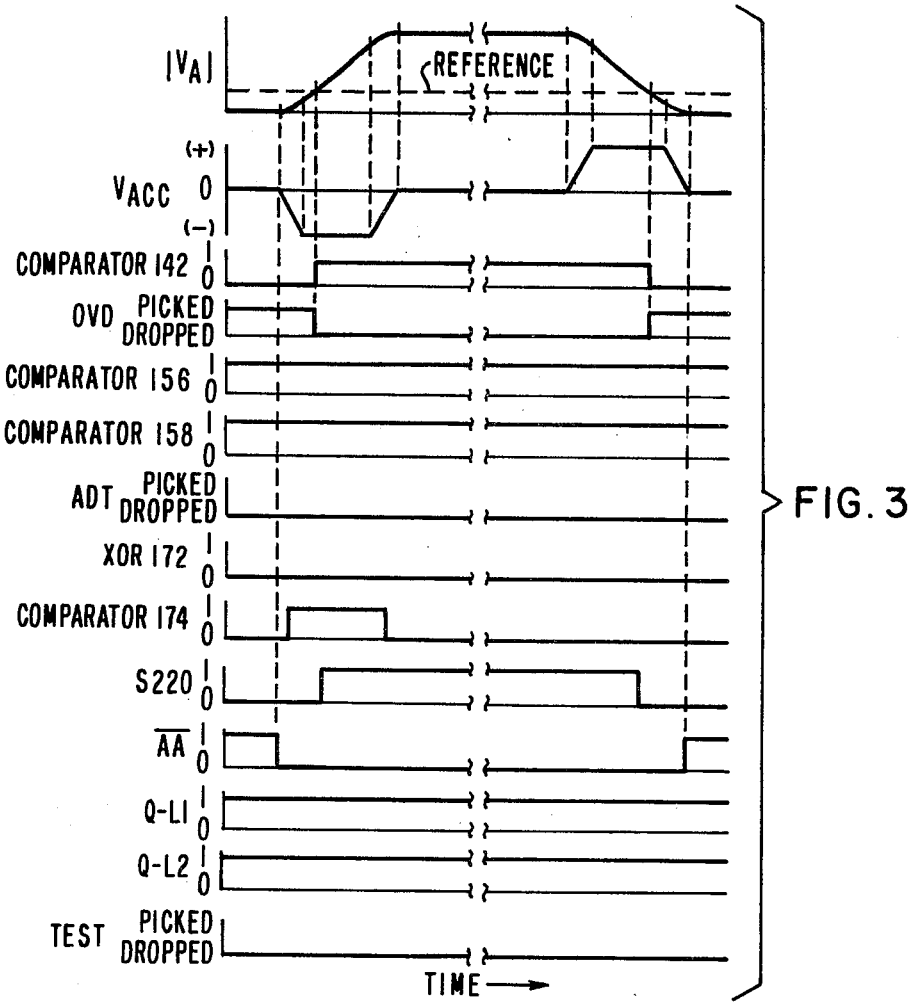
FIG. 3 is a timing diagram useful in understanding the operation of the invention shown in FIGS. 1 and 2.

XOR gate 172 compares the outputs of comparators 156 and 158. Their outputs, as shown in FIG. 3, should always be the same, and thus XOR gate 172 normally outputs a logic zero. Should the outputs of these comparators differ, i.e., be at different logic levels, it indicates a malfunction of one of the comparators, and XOR gate 172 will output a logic one. The output of XOR gate 172 is applied to the reset input of latch 178, which may be a D-type flip-flop. Latch 178 is set by power "on", or by maintenance personnel via set circuitry 184, which includes a pushbutton 186. Initial application of power results in inverter gate 185 momentarily applying a logic one to the set input of latch 178, setting its Q output to a logic one. Actuation of pushbutton 186 also sets the Q output of latch 178 to a logic one. If the output of XOR gate 172 goes to a logic one, indicating a malfunction in the overacceleration circuit, it resets the Q output of latch 178 to a logic zero. The Q output of latch 178 is applied to the data input D of latch 180, which may also be a D-type flip-flop. The data input is clocked to the Q output of latch 180 at the end of a run, such as by signal $\overline{AA}$ which goes high to clock the latch when the brake is set (contact BK-1 closes) at the end of a run. If the Q output is a logic zero, indicating a malfunction in the overacceleration circuit, relay driver 182, which may include an op amp 188, outputs a logic zero to energize relay TEST. Its contact TEST-1 in the circuit of protective relay CPR thus opens to drop relay CPR and prevent the elevator car from restarting.

Figure 2:
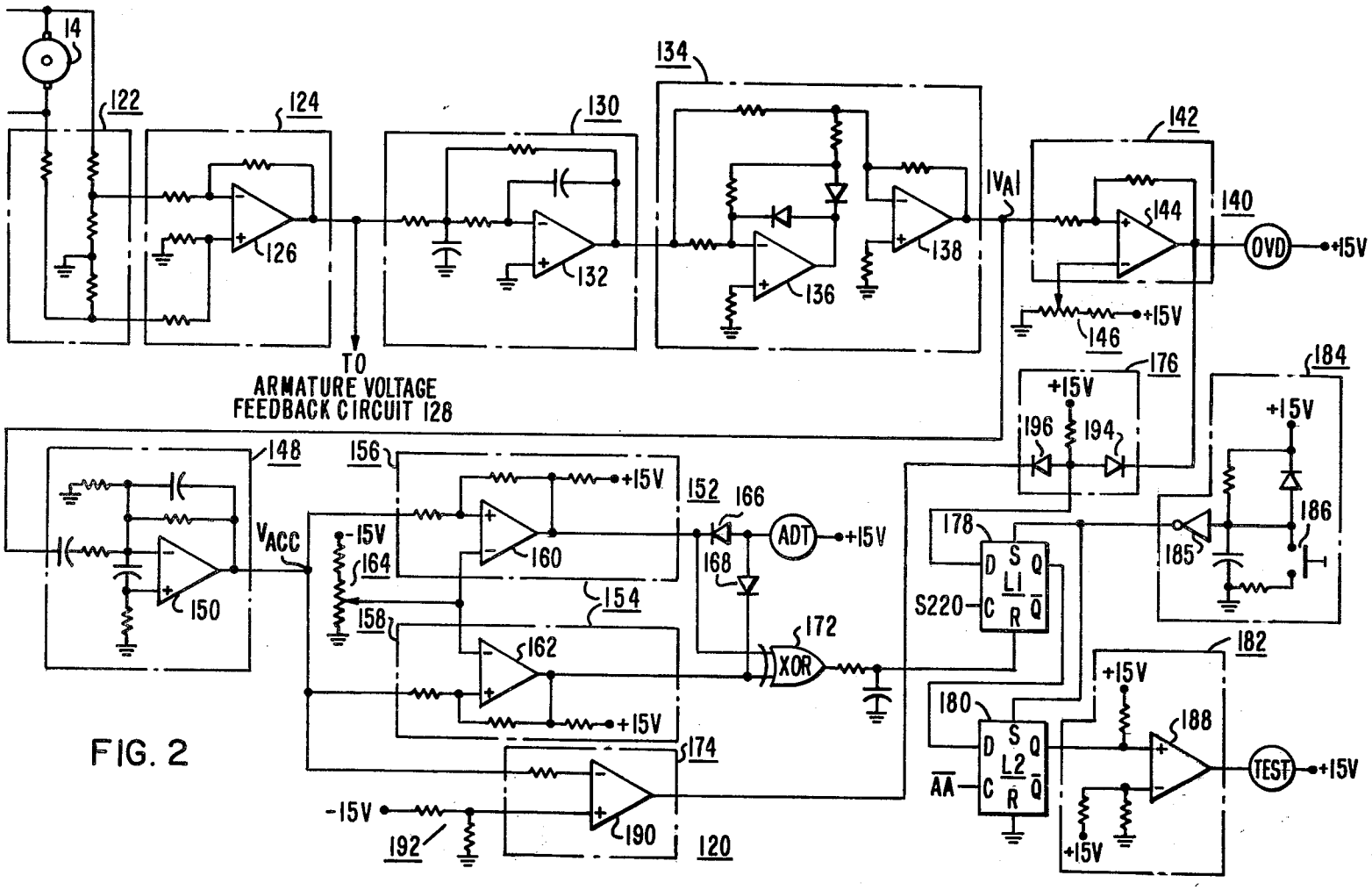
FIG. 2 is a detailed schematic diagram illustrating a specific embodiment of the invention shown in FIG. 1.

A self-test of the comparator 142 and differentiator 148 compares the outputs of comparators 142 and 174. Comparator 174, which may include an op amp 190, is set to be responsive to the output of differentiator 148, i.e., the acceleration signal $V_{ACC}$. Signal $V_{ACC}$ is applied to the inverting input of op amp 190, and a negative reference voltage 192 is applied to its non-inverting input. The reference 192 is just slightly negative, to cause the output of op amp 190 to normally switch to a logic one as soon as acceleration of the drive motor 12 is initiated. When the armature voltage reaches the magnitude of reference 146, the output of comparator 142 should normally switch to a logic one. The outputs of comparators 142 and 174 are connected to the data input D of latch 178 via AND gate 176. AND gate 176 may be constructed of diodes 194 and 196 and a positive source of unidirectional potential, as illustrated in FIG. 2. Latch 178 is then clocked during the acceleration portion of the run, at a time when both comparators 142 and 174 should be providing logic one signals, such as by using signal S220 as the clocking signal. Signal S220 goes to a logic one when the speed of the elevator car 40 reaches 220 FPM. If the differentiator 148 and comparators 142 and 174 are all operating correctly, a logic one will be applied to the D input of latch 178 at the time it is clocked, and thus a logic one will be applied to the D input of latch 180 at the end of the run when latch 180 is clocked. Thus, relay TEST will remain in its de-energized state. Should differentiator 148, comparator 174, or comparator 142 malfunction, a logic zero will be applied to latch 178 by AND gate 176 at the time latch 178 is by S220, and a logic zero will be applied to the D input of latch 180 when it is clocked by $\overline{A}$, picking up relay TEST and preventing the car from restarting.

FIG. 3 illustrates the timing waveforms of a normal run of the elevator car 40. Relay OVD is normally dropped out only during the higher speed portion of a run. It picks up as the car slows down for a landing. If relay OVD should drop out during landing, an emergency stop will be initiated. Comparators 156 and 158 normally each have a logic one output. Should either, or both, switch to a logic zero, relay ADT, which is normally dropped out, will pick up and initiate an emergency stop. The output of XOR gate 172 is normally a logic zero. Should the outputs of comparators 156 and 158 differ, its output changes to a logic one, preventing the car from restarting after it has completed its present run. The outputs of comparators 142 and 174 should both be a logic one during the acceleration of the elevator car. Should one, or both, be at the logic zero level at the car speed at which they are compared, the car will be prevented from restarting, after it has completed its present run.

Thus, there has been disclosed a new and improved elevator system which utilizes already available apparatus for deriving a signal proportional to motor armature voltage, eliminating the need for a special transformer and additional high voltage resistors. The armature voltage monitoring apparatus is all solid-state, except for three mercury wetted reed relays, enabling the circuitry to be mounted on a PCB board and supported in a PC cage. Self-testing circuitry checks the overvoltage and overacceleration functions during each run of the elevator car, to provide a highly reliable, yet relatively low cost, motor armature monitoring function.

We claim as our invention:

1. An elevator system comprising:

an elevator car having door means operable between open and closed positions, motive means for said elevator car, including an adjustable voltage source and a drive motor having an armature circuit, overvoltage means monitoring the voltage in the armature circuit of said drive motor, and for providing a first true signal when the voltage exceeds a predetermined magnitude, overacceleration means monitoring the rate-of-change of the voltage in the armature circuit of said drive motor, and for providing a second true signal when the rate-of-change exceeds a predetermined magnitude, at least when the voltage is increasing, test means for testing the operability of said overvoltage means and said overacceleration means during each run of the elevator car, and for providing a third true signal when the tests indicate a malfunction, and protective means responsive to said first, second and third signals, said protective means initiating an emergency stop of said elevator car when said first signal is true when the elevator car is in the process of landing, initiating an emergency stop of said elevator car when said second signal is true, and for preventing the elevator car from starting another run when said third signal is true.

2. The elevator system of claim 1 wherein the overvoltage means includes absolute value means, first reference means, and first comparator means, which cooperatively monitor overvoltage in both the up and down travel directions of the elevator car.

3. The elevator system of claim 1 wherein the protective means is only responsive to the first signal when the door means of the elevator car is not closed.

4. The elevator system of claim 1 wherein the overacceleration means includes absolute value means, differentiator means, second reference means, and second comparator means, which cooperatively monitor overacceleration in both the up and down travel directions of the elevator car.

5. The elevator system of claim 4 wherein the second comparator means includes a pair of comparators, both of which are responsive to the differentiator means and to the second reference means, with the second true signal being provided when either comparator detects a rate-of-change which exceeds the level of the second reference means.

6. The elevator system of claim 5 wherein the test means includes means which compares the outputs of the pair of comparators, and provides the third true signal when they differ.

7. The elevator system of claim 6 including means for delaying the application of the third true signal to the protective means until the end of a run of the elevator car.

8. The elevator system of claim 4 wherein the test means includes third comparator means responsive to the differentiator means, which should provide a true output signal whenever the elevator car is accelerated, means for comparing the outputs of the first and third comparator means at a time when their outputs should both be true, with the test means providing the third true signal when they are not both true at the comparison time.

9. The elevator system of claim 8 including means for delaying the application of the third true signal for the protective means, until the end of the run of the elevator car.

10. The elevator system of claim 1 including absolute value means for providing an armature voltage signal which has the same polarity for both the up and down travel directions of the elevator car, and wherein the overvoltage means and the overacceleration means are both responsive to said absolute value means.

11. The elevator system of claim 1 including attenuation means and amplifier means responsive to the voltage in the armature circuit, for providing a signal for the overvoltage and overacceleration means.

12. The elevator system of claim 11 including drive control for the adjustable voltage source, and armature voltage feedback means for the drive control, with the armature voltage feedback means being responsive to the signal provided by the attenuation and amplifier means.

13. The elevator system of claim 1 wherein the overvoltage means, overacceleration means, and test means, each include one mercury wetted reed relay, with the balance of their circuitry being solid state.

* * * * *